US012070074B2

(12) United States Patent
Janfada et al.

(10) Patent No.: US 12,070,074 B2
(45) Date of Patent: Aug. 27, 2024

(54) APPARATUS AND METHOD FOR VAPORIZING OILS

(71) Applicant: CLIR LIFE EXTRACTIONS INC., Vancouver (CA)

(72) Inventors: Arash Janfada, Maple Ridge (CA); Tashfiq Alam, Vancouver (CA); Sanad Aridah, Port Coquitlam (CA)

(73) Assignee: CLIR TECHNOLOGIES INC., Vancouver (CA)

( * ) Notice: Subject to any disclaimer, the term of this patent is extended or adjusted under 35 U.S.C. 154(b) by 578 days.

(21) Appl. No.: 17/239,791

(22) PCT Filed: Nov. 14, 2019

(86) PCT No.: PCT/CA2019/051622

§ 371 (c)(1),
(2) Date: Apr. 26, 2021

(87) PCT Pub. No.: WO2020/097729

PCT Pub. Date: May 22, 2020

(65) Prior Publication Data

US 2021/0401054 A1 Dec. 30, 2021

Related U.S. Application Data

(60) Provisional application No. 62/848,168, filed on May 15, 2019, provisional application No. 62/767,514, filed on Nov. 15, 2018.

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/46* (2020.01)

(58) Field of Classification Search
CPC ..... A24F 47/008; A24F 40/42; A24T 40/485
See application file for complete search history.

(56) References Cited

U.S. PATENT DOCUMENTS

2013/0192616 A1* 8/2013 Tucker ..... A24F 40/70 131/328
2015/0053220 A1 2/2015 Levy et al.
(Continued)

FOREIGN PATENT DOCUMENTS

CN 204763415 U 11/2015
CN 105307520 A 2/2016
(Continued)

OTHER PUBLICATIONS

EPO, European Search Opinion for European Patent Application 19885380.6 dated Aug. 2, 2022.
(Continued)

*Primary Examiner* — Neil Abrams
(74) *Attorney, Agent, or Firm* — Norton Rose Fulbright Canada LLP

(57) ABSTRACT

An apparatus and method for vaporizing oil are disclosed herein. The apparatus includes a first chamber acting as a reservor for oil, and a second chamber insulated from the first chamber where vaporizing takes place. The degradation of oil may be reduced due to the insulation between chambers.

21 Claims, 9 Drawing Sheets

(51) Int. Cl.
*A24F 40/42* (2020.01)
*A24F 40/46* (2020.01)

(56) References Cited

U.S. PATENT DOCUMENTS

| | | | | |
|---|---|---|---|---|
| 2015/0216237 | A1 | 8/2015 | Wensley et al. | |
| 2017/0258140 | A1 | 9/2017 | Rostami et al. | |
| 2017/0354186 | A1 | 12/2017 | Johnson et al. | |
| 2018/0098573 | A1 | 4/2018 | Yu et al. | |
| 2018/0249762 | A1 | 9/2018 | Daryani et al. | |
| 2019/0124982 | A1* | 5/2019 | Atkins | A24F 40/30 |

FOREIGN PATENT DOCUMENTS

| | | | |
|---|---|---|---|
| CN | 106388002 | A | 2/2017 |
| CN | 106579566 | A | 4/2017 |
| CN | 107772541 | A | 3/2018 |
| CN | 108289505 | A | 7/2018 |
| CN | 108685179 | A | 10/2018 |
| WO | 2017113106 | A1 | 7/2017 |
| WO | 2017163052 | A1 | 9/2017 |

OTHER PUBLICATIONS

CNIPA, Office Action dated Jun. 26, 2023 received in Chinese Patent Application No. 201980073801.1.
WIPO, International Search Report and Written Opinion for PCT Application No. PCT/CA2019/051622 dated Jan. 21, 2020.
Office Action issued by Chinese Patent Office in connection with CN 201980073801 dated Dec. 19, 2023.

* cited by examiner

APPARATUS AND METHOD FOR VAPORIZING OILS

CROSS-REFERENCE TO RELATED APPLICATIONS

This application claims the benefit of U.S. Provisional Application No. 62/767,514, filed Nov. 15, 2018, and of U.S. Provisional Application No. 62/848,168, filed May 15, 2019. The contents of the aforementioned applications are incorporated by reference in their entireties.

FIELD OF INVENTION

This relates to vaporization and consumption devices, and in particular to device used to vaporize and consume oils.

BACKGROUND

U.S. Design patent application Ser. No. 29/478122, issued as U.S. Design Pat. No. D747,548 S, discloses an electronic cigarette tank with a single coil in the center, surrounded by a single oil reservoir. Such tanks are designed for nicotine concentrates and can degrade oil quality if used for cannabis oil, as repeated heat exposure and differential volatilization adversely modify the chemical composition and flavor profile prematurely.

Cannabis oil is a complex mixture of many chemical constituents, and may experience chemical fractionation (that is, constituent components begin to differentially separate, evaporate or degrade), which adversely affects the quality of the cannabis oil. Fractionation of oil within a vaporizing device may be caused by a number of factors, including a) chromatographic effects of the wicking material in the vaporizing device, b) the volatility of the oil, and c) exposing the oil to heat.

Conventional cannabis oil vaporizers (COV) comprise a single reservoir of concentrate oil surrounding an atomizer at the core. Most atomizers comprise a metallic coil with cotton wicked through it. The cotton absorbs the oil in the surrounding reservoir and exposes it to the heat which is applied through conduction by the coil. The coil uses basic principles of electricity by running a regulated electrical current (typically from a set of batteries) through a metal wire of a predetermined electrical resistance. The resistance of the wire and the current running though the wire translate to power losses which manifest in the form of heat and light as per the following formula: $P=I^2R$. Various experiments place the ideal temperature range for vaporizing cannabis oil between 175-210° C. As noted above, exposure to heat may cause the fractionation of cannabis oil to accelerate.

Moreover, exposure to UV light and oxygen can increase the rate of degradation of cannabis oil, as UV rays break down organic matter, and may do so almost instantaneously with certain compounds.

Therefore, there is a need for a cannabis oil vaporizer which ameliorates one or more of the above-noted challenges associated with conventional cannabis oil vaporizers.

SUMMARY

In accordance with one aspect, there is provided an apparatus for vaporizing oil, the apparatus comprising: a first chamber for storing oil to be vaporized; a second chamber for vaporizing said oil, said second chamber being selectively fluidly coupled to said first chamber, and said second chamber being thermally insulated from said first chamber; and a chimney connecting said second chamber to an external vent.

In accordance with another aspect, there is provided a method of vaporizing oil, the method comprising: transporting said oil from a first chamber to a second chamber, said second chamber being thermally insulated from said first chamber; vaporizing said oil via a heating element within said second chamber; ventilating said vaporized oil from said second chamber to an external vent.

DETAILED DESCRIPTION

Figure 1:
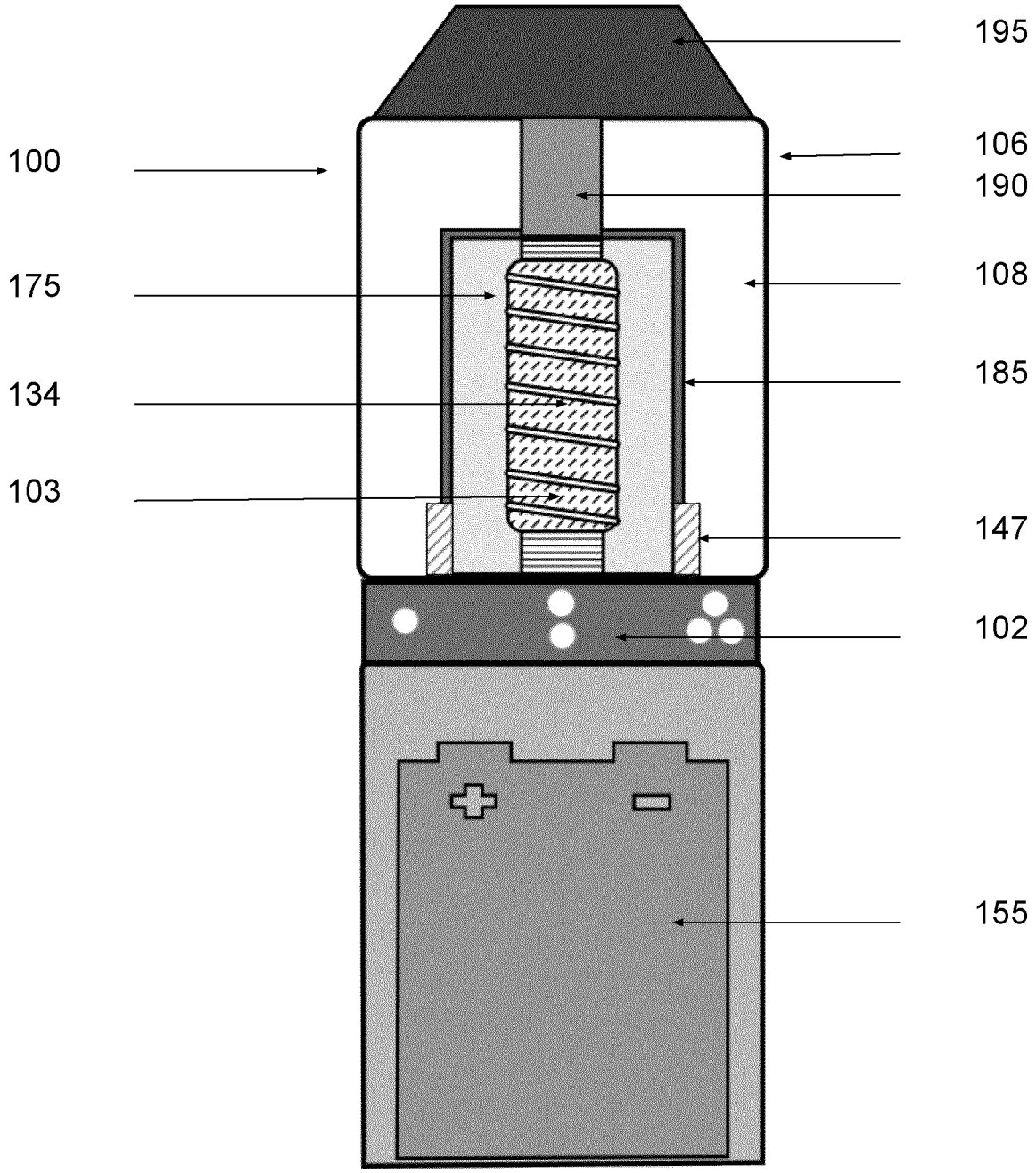
FIG. 1 is a cross-sectional view of an example vaporizing device, according an embodiment.

FIG. 1 is a cross-sectional view of an example vaporizing device 100. In some embodiments, vaporizing device 100 is configured to vaporize cannabis oil. As depicted, vaporizing device 100 has a dual chamber configuration which may allow a user to dispense controlled doses of cannabis oil concentrate for vaporization while enjoying a fairly consistent flavor profile with reduced degradation relative to conventional vaporizing devices.

As depicted, vaporizing device 100 includes two chambers: a primary chamber (referred to hereinafter as primary reservoir) 106 and a secondary chamber 175. Vaporization occurs within secondary chamber 175, and primary reservoir 106 acts primarily as a reservoir for storing the bulk of the cannabis oil 108 which is not in the process of being vaporized. In some embodiments, primary reservoir 106 and secondary chamber 175 are separated by a barrier 185. Barrier 185 may be comprised of material such as aluminum oxide, titanium oxide, chromium, or the like. In other embodiments, barrier 185 may have a double-walled configuration of aluminum oxide, titanium oxide, or chromium with an air-filled or evacuated interstitial space. In some embodiments, barrier 185 provides heat insulation between primary reservoir 106 and secondary chamber 175. Chimney 190 provides a path for vaporized cannabis oil to exit secondary chamber 175 and ultimately exit vaporizing device 100 for consumption (e.g. inhalation) by a user via external vent 195. In some embodiments, external vent 195 is a mouthpiece configured to allow a user to inhale vapor from chimney 190. Primary reservoir 106 may include a main reservoir of oil 108 (e.g. cannabis oil) which is at least partially insulated from heat generated in secondary chamber 175.

Secondary chamber 175 contains a heating element 134, depicted in FIG. 1 as a metal coil. It should be noted that other vaporizing mechanisms may be used in the embodiments disclosed herein, such as a ceramic vaporizing plate, an ultrasonic vaporizer, or the like. In some embodiments, secondary chamber 175 is smaller in volume than primary reservoir 106. In some embodiments, secondary chamber 175 holds enough cannabis oil for a limited number of doses. In some embodiments, vaporization of cannabis oil 108 occurs in secondary chamber 175, while cannabis oil 108 contained in primary reservoir 106 is insulated from the heat and differential volatilization that results from direct heating that occurs in secondary chamber 175. This may reduce the degree of fractionation and degradation experienced by the oil 108 in primary reservoir 106.

As oil is vaporized in secondary chamber 175, oil from primary reservoir 106 may be used to replace or re-fill the oil consumed in secondary chamber 175. In some embodiments, oil may flow from primary reservoir 106 to secondary chamber 175. In some embodiments, oil may be transported from primary reservoir 106 to secondary chamber 175 via one or more valves 147. In some embodiments, valve 147 is a one-way valve configured to allow flow of oil from primary reservoir 106 to secondary chamber 175, and preventing flow of oil from secondary chamber 175 to primary reservoir 106. In some embodiments, valve 147 may be a squeeze bottle valve, a vacuum valve, a gravity valve, or any combination of passive and active mechanism of actuation.

One-way valve 147 may allow the oil to flow in one direction, namely into the secondary chamber 175 from primary reservoir 106 so that the heat-affected oil is unable to contaminate the bulk oil contained within primary reservoir 106. The oil flow through valve 147 may also be controlled by adjusting the size of air flow holes 102, using the vacuum created by suction applied to chimney 190 (e.g. when a user inhales from a vaporizing device via external vent 195), because the difference in air pressure created by controlling the size of the air flow holes 102 causes the oil to be drawn from the primary reservoir 106 into the second chamber 175 is related to the size of the air flow holes 102 selected.

As depicted in FIG. 1, secondary chamber 175 is contained within primary reservoir 106. However, in some embodiments, secondary chamber 175 may be above or below primary reservoir 106. Primary reservoir 106 may be constructed from glass, acrylic, aluminum or the like.

As depicted, secondary chamber 175 contains a heating element 134. Heating element 134 is illustrated as a coil, with electrical current supplied by battery 155. In some embodiments, heating element 134 is a metallic coil which is made of one of Kental, NiChrome, stainless steel, Nickel or Titanium with varying resistances. Regulated electrical current travelling through the coil causes heat dissipation, which in turn heats up wicking material 103, and the neighboring cannabis oil in secondary chamber 175. The heat may be sufficient to vaporize the oil in secondary chamber 175, which is then expelled via chimney 190 and external vent 195. In some embodiments, heating element 134 is situated to expose only the secondary chamber 175 to heat, while keeping the primary reservoir 106 insulated from said heat via barrier 185.

Wicking material 103 is exposed in the secondary chamber 175 to draw in the oil near heating element 134. In some embodiments, wicking material 103 may be Japanese cotton, cellulose cotton, rayon, hemp, or the like. Some embodiments may incorporate a wickless design, wherein heating element 134 is a coil formed as a cylindrical mesh, such as one made of stainless steel, aluminum, titanium or similar, which enhances or maximizes the surface area for heat exposure. The capillary effect, otherwise known as capillary action or wicking, may cause the oil to remain held within the matrix of the mesh. In some embodiments, the openings in the matrix of the mesh are dimensioned so as to promote capillary action.

Chimney 190 is an airway which delivers the vaporized oil produced by heating element 134 to the user. As depicted in FIG. 1, the chimney 190 intake is positioned vertically above an end of heating element 134. The chimney 190 exhaust protrudes out of primary reservoir 106 of the vaporizing device 100 to external vent 195 (e.g. a mouthpiece) to provide the user with access to draw out the vaporized oil via, for example, suction. Air flow holes 102 regulate airflow in the vicinity of heating element 134 and through chimney 190. The airflow can be controlled by, for example, changing the diameter of the intake holes or the number of intake holes. Changing the diameter of air intake holes may affect parameters such as the temperature of heating element 134 temperature, as well as the resulting vapor density. As depicted in FIG. 1, vaporizing device may contain a plurality of settings with a different number of air flow holes or a single air flow hole. In some embodiments, the number of open holes in the air flow holes 102, or the aperture of the single intake hole, may be controlled via a circular closure valve that can be rotated to select from among the plurality of settings. For example, if more air intake is desired, the configuration having 3 intake holes may be rotated into place. If less air intake is desired, the configuration having 2 or 1 intake holes may be rotated into place.

In some embodiments, the airflow can be variable diameter or can have a single standard diameter for each air intake hole.

In some embodiments, vaporizing device 100 is connected to a power source (e.g. battery 155) using an industry standard "510" thread screw assembly. In some embodiments, the 510 thread screw assembly is 7 mm in diameter and comprises 10 threads that are 0.5 mm apart. In other embodiments, vaporizing device 100 can connect to a power source with connector which is assisted by a magnetic force, with the power being delivered to heating element 134 via spring-loaded contacts (otherwise known as "pogo pins"). The magnetic force may be from directional programable magnets, where magnetic attraction and repulsion are a function of the planar orientation of the reciprocal magnets. The foregoing are merely two examples of connections—the use of other available power connector types is contemplated.

Figure 2:
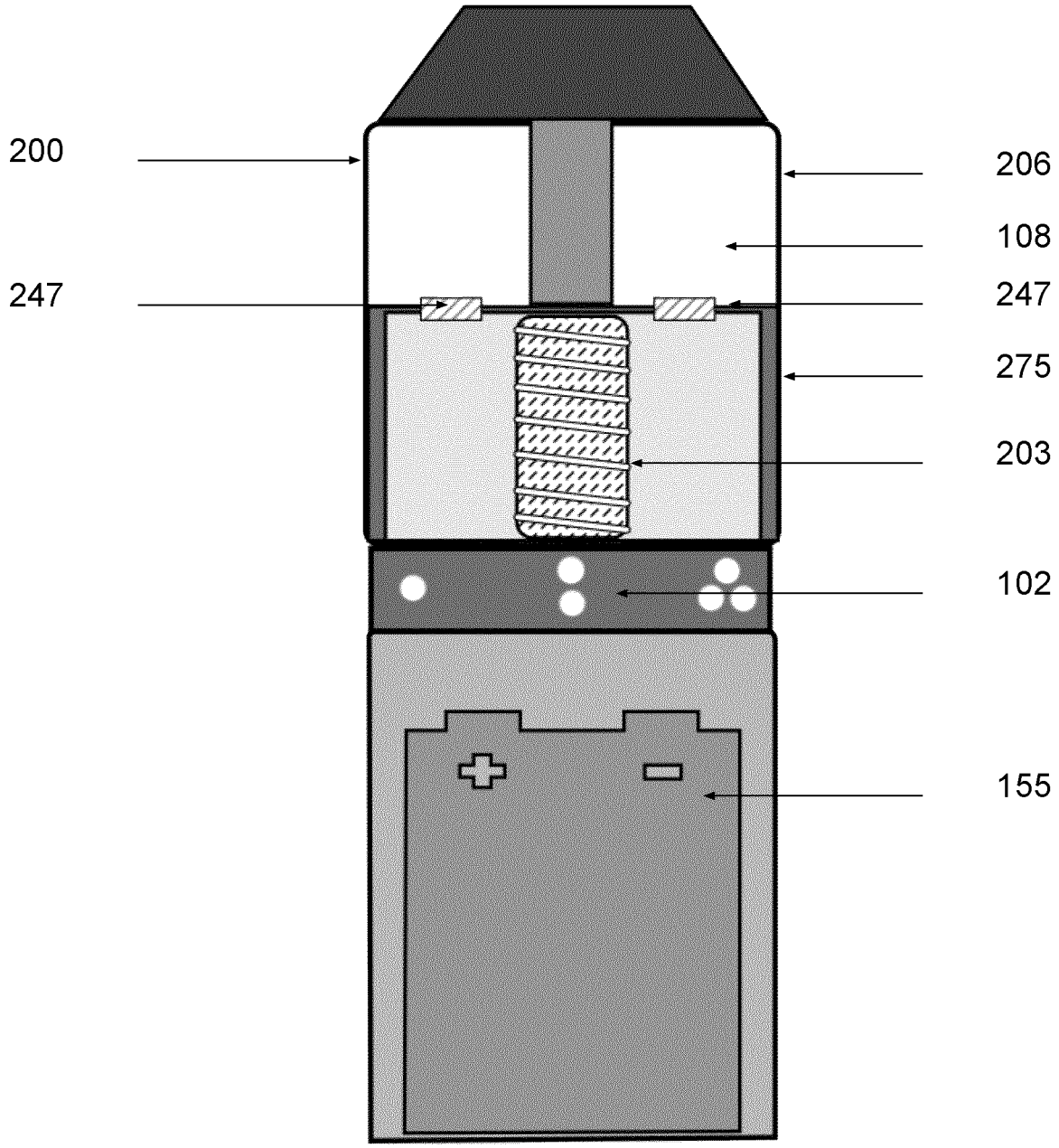
FIG. 2 is a cross-sectional view of an alternative embodiment of a vaporizing device.
Figure 8:
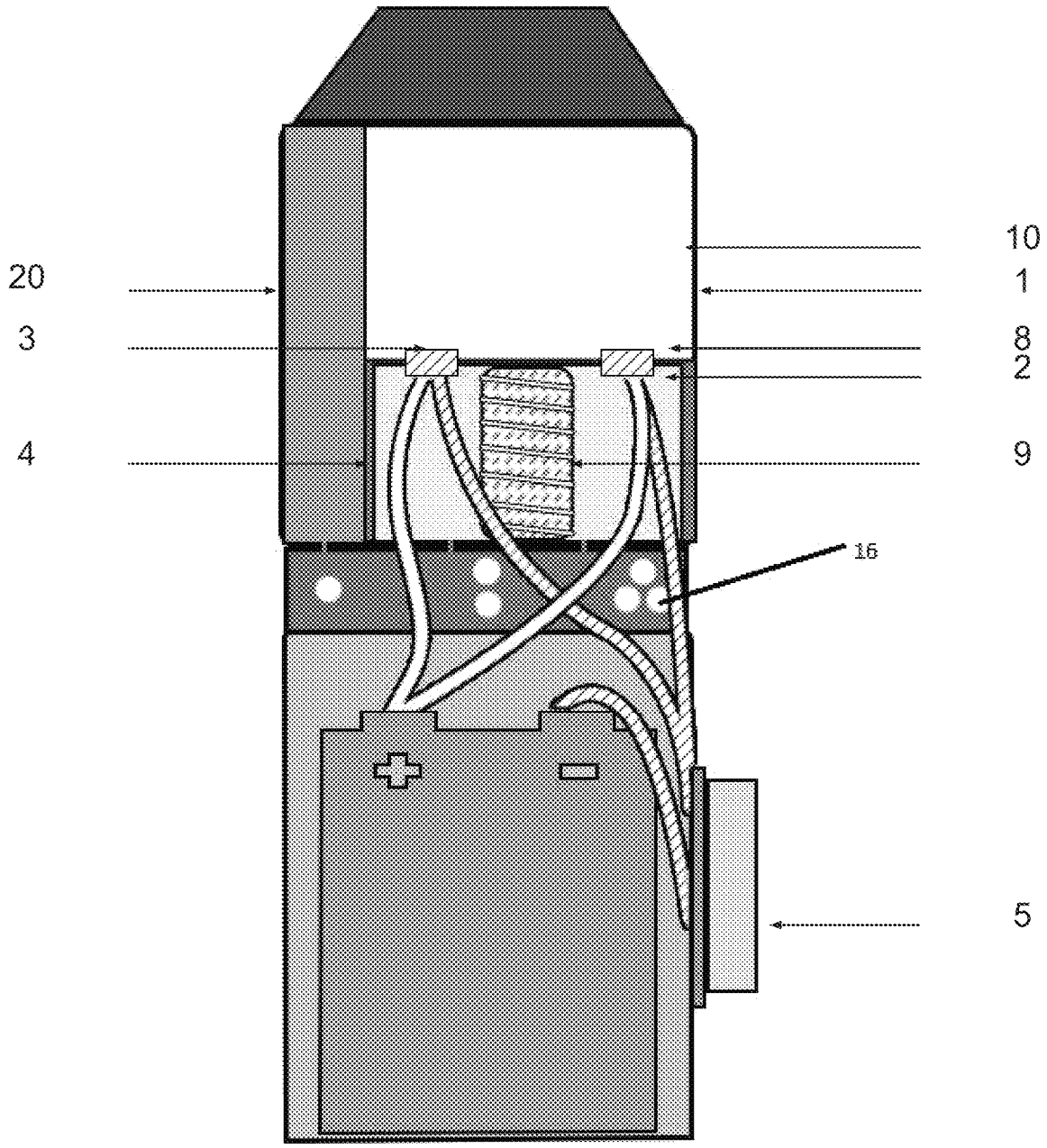
FIG. 8 is a cross-sectional view of an alternative embodiment of a vaporizing device.

FIG. 2 is a cross-sectional view of an alternative embodiment of a vaporizing device 200. As depicted, primary reservoir 206 is located vertically above secondary chamber 275, rather than secondary chamber 175 being located within primary reservoir 106 as depicted in FIG. 1. The configuration of FIG. 2 may allow for oil 108 to be transported, with the aid of gravity, from primary reservoir 206 to secondary chamber 275 via one or more one-way valves 247. In device 200, the oil flow through valve 247 may be controlled primarily by the vaporization of oil via the heating element 203. In some embodiments, secondary chamber 275 may remain topped up at all times, as any volume of oil which is vaporized will be replaced by new oil from primary reservoir 206. In some embodiments, one-way valve 247 may be replaced by a small opening whose size is calibrated for the viscosity of oil 108 to minimize or reduce the communication of fluid between the primary reservoir 206 and secondary chamber 275 while still allowing fluid to pass from primary reservoir 206 to secondary chamber 275. FIG. 8, described further below, depicts an alternative embodiment in which primary reservoir 1 is embodied as a detachable pod which may be disposable and/or refillable.

Figure 3:
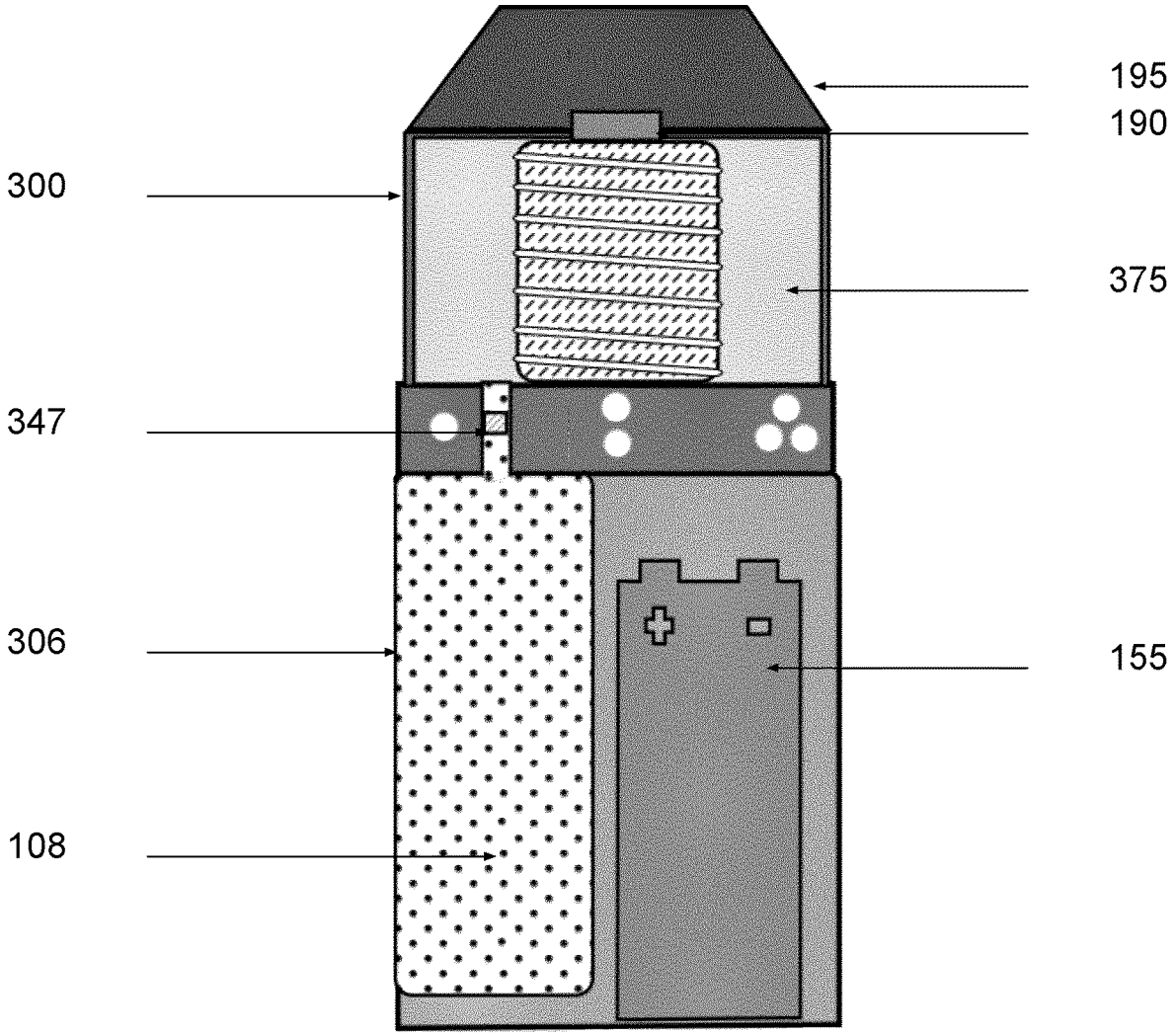
FIG. 3 is a cross-sectional view of an alternative embodiment of a vaporizing device.

FIG. 3 is a cross-sectional view of an alternative embodiment of a vaporizing device 300. Device 300 may be particularly well-suited for use with a wide range of different cannabis oil viscosities. In this embodiment, vaporizing device 300 includes a primary reservoir 306 fluidly coupled to secondary chamber 375 via a one-way valve 347. In some embodiments, primary reservoir 306 is made of a resilient-elastic or flexible material (e.g. low-density polyethylene), such that the user of device 300 can squeeze primary reservoir 306 (i.e. apply pressure) to force the oil 108 within primary reservoir 306 through one-way valve 347 and into secondary chamber 375. In some embodiments, the coil may be actuated simultaneously as primary reservoir 306 is squeezed to ensure that all oil 108 entering secondary chamber 375 is vaporized. In some embodiments, one-way valve 347 is an electro-mechanical valve, such as a miniature solenoid valve (which are commercially available), to ensure that a metered quantity of oil 108 is delivered into secondary chamber 375 without causing secondary chamber 375 to become oversaturated with oil. One-way valve 347 may be closed by default and actuated to the open position when primary reservoir 306 is squeezed.

Figure 4:
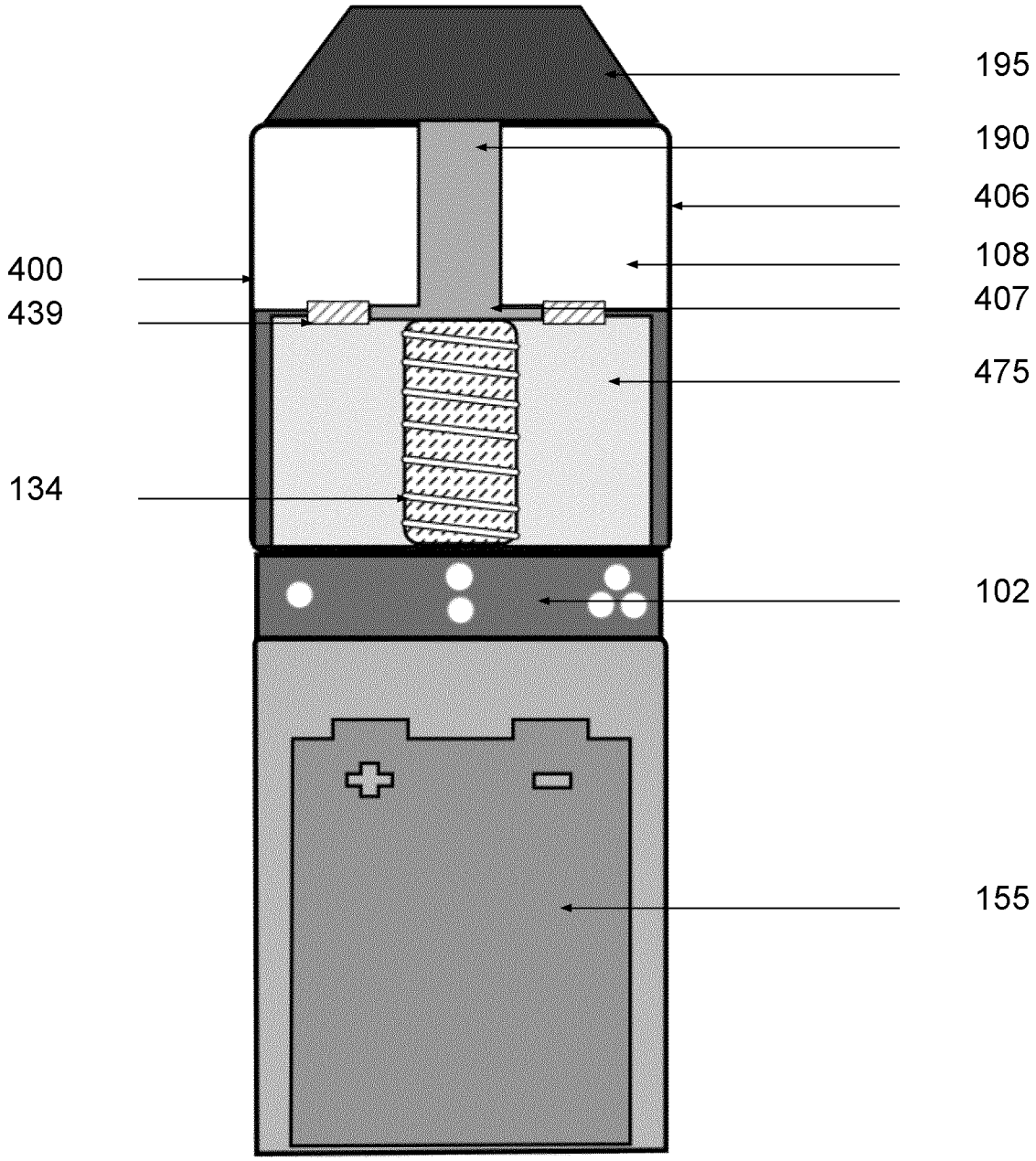
FIG. 4 is a cross-sectional view of an alternative embodiment of a vaporizing device.

FIG. 4 is a cross-sectional view of an alternative embodiment of a vaporizing device 400. As depicted, the boundary between primary reservoir 406 and secondary chamber 475 includes vacuum-triggered valves 439 fluidly connected to capillary tubes 407. Vacuum-triggered valves 439 may be comprised of ball valves. Capillary tubes are further fluidly connected to chimney 190. In operation, the flow of oil from primary reservoir 406 to secondary chamber 475 can be regulated to occur only when there is a negative air pressure in chimney 190 by inhaling vapor from external vent 195. This induces negative air pressure in the capillary tubes 407 resulting in the opening of vacuum-triggered valves 439. In some embodiments, valves 439 may be mechanical or electronic. In embodiments in which valve 439 is electronic, a negative air pressure sensor may trigger heating element 134 as well as valve 439. In this manner, the vaporizing of oil and refilling of secondary chamber 475 may occur automatically as oil is consumed.

The viscosity of a particular blend or type of cannabis oil may have a performance impact on a vaporizing device. For example, the viscosity of a fluid will have an impact on how quickly or slowly that fluid is able to flow. Although cannabis oil is a non-Newtonian fluid, it still holds that in general, as pressure or force applied to cannabis oil is increased, the flow rate will increase. It is important that when a vaporizing device is activated, the cannabis oil begins to vaporize almost simultaneously. As described herein, a vaporizing device may be activated or actuated via inhalation as triggered by a pressure sensor, via a press-button switch, or the like. As the viscosity of cannabis oil increases, certain embodiments may be more suitable to ensure adequate flow rates from primary reservoir to secondary chamber. In particular, embodiments which apply a force or pressure greater than that of gravity alone may be particularly suitable for use with higher viscosity cannabis oils.

Figure 7:
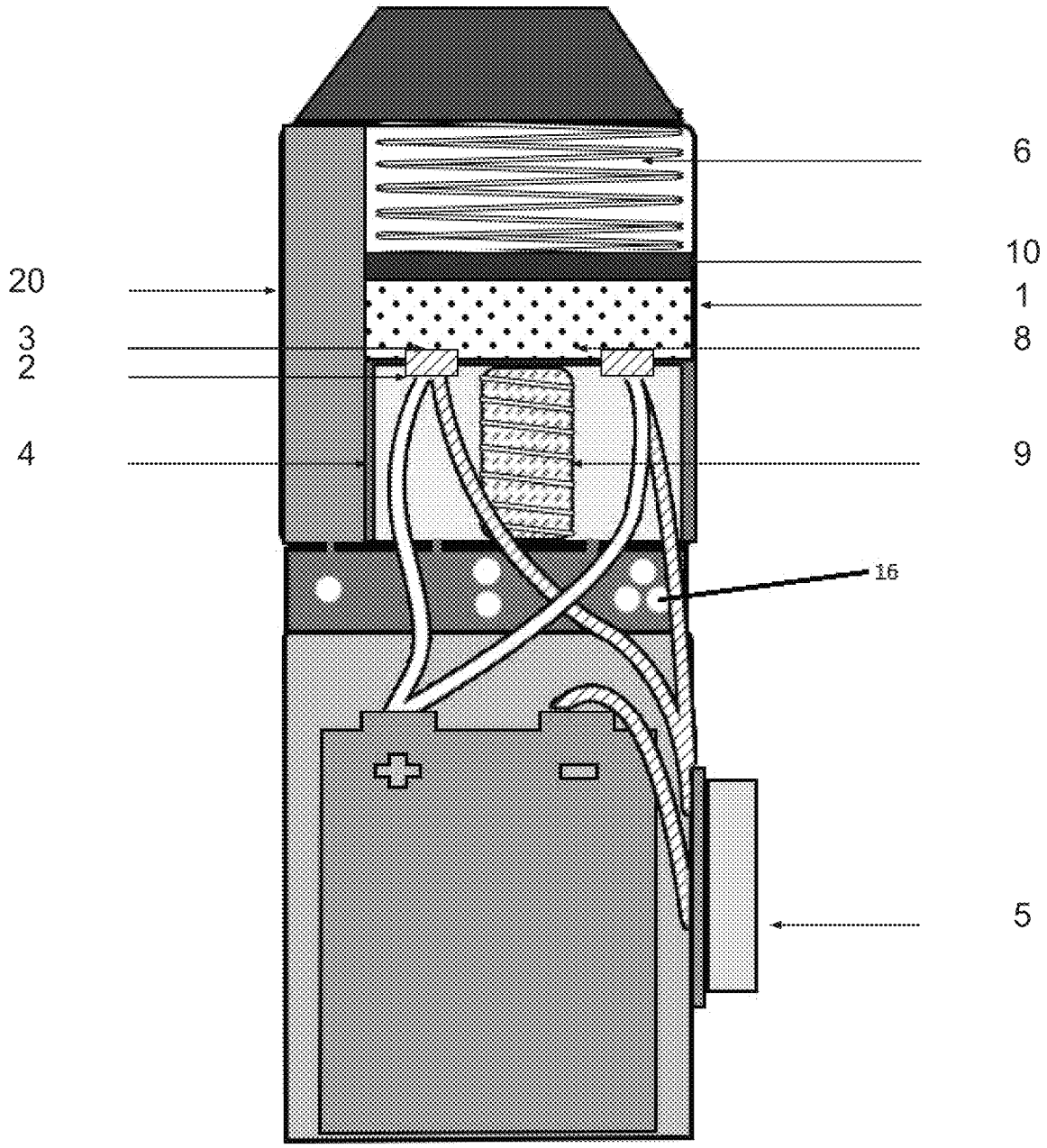
FIG. 7 is a cross-sectional view of an alternative embodiment of a vaporizing device.

FIG. 7 is a cross-sectional view of an alternative embodiment of a vaporizing device 700. Device 700 may be particularly suitable for use with cannabis oil having a high viscosity (e.g. as high as 15,000 centipoises or even higher). As depicted, primary reservoir 1 is a detachable pod which may be any of disposable, reusable, and/or refillable. Primary reservoir 1 may be filled with cannabis oil 8 and is sealed by way of sealed port 2. In some embodiments, sealed port 2 is an opening sealed by, for example, a plastic membrane or the like. The pod housing primary reservoir 1 may be seated into the rest of the device 700 by inserting a valve (e.g. one-way valve 3) into sealed port 2, thereby puncturing the seal and allowing fluid communication between primary reservoir 1 and secondary chamber 4 via one-way valve 3 (when open).

Primary chamber 1 further includes a compression spring 6 which pushes on piston/plunger 10. Piston 10 is fitted to primary chamber 1 such that piston 10 is always applying downward pressure to oil 8 via spring 6. In some embodiments, one-way valve 3 is a solenoid or similar electro-mechanical type valve which can be controlled via an electronic signal (e.g. a sensor switch triggered by a negative pressure induced through inhalation, or mechanical switch or button 5). As such, when the user triggers switch 5, the valve 3 opens, thereby forcing cannabis oil 8 into secondary chamber 4. Simultaneously, triggering switch 5 may further cause electric current to activate coil 9 in secondary chamber 4. The heating of coil 9 may cause the cannabis oil 8 forced into secondary chamber to vaporize and be drawn out by a user via vent 20, which is in fluid communication with air holes 16 and secondary chamber 4. Device 700 may be particularly suitable for high viscosity cannabis oils because the spring 6 and piston 10 combine to exert a force or pressure on the oil 8 in primary reservoir 1, rather than relying only on gravity.

FIG. 8 is a cross-sectional view of an alternative embodiment of a vaporizing device 800. Device 800 is similar to device 700 in many respects, including that the primary reservoir 1 pod is removable and refillable, with the exception that there is no spring 6 or plunger 10 within primary reservoir 1. As such, there is no active force being applied to the oil 8 to force the oil 8 to move to secondary chamber 4 when the one-way valve 3 is opened. Device 800 depicted in FIG. 8 may be particularly suitable for low viscosity oils, as a low viscosity oil can be expected to more readily flow to secondary chamber 4 via the action of gravity, without additional forces. Moreover, because there is no active pressure being applied, device 800 may use a simple passive one-way valve 3, rather than an electro-mechanical valve, which may reduce cost and complexity. As with the embodiment depicted in FIG. 8, the heating of coil 9 may cause the *cannabis* oil 8 guided into secondary chamber 4 by gravity to vaporize and be drawn out by a user via vent 20, which is in fluid communication with air holes 16 and secondary chamber 4.

Figure 9:
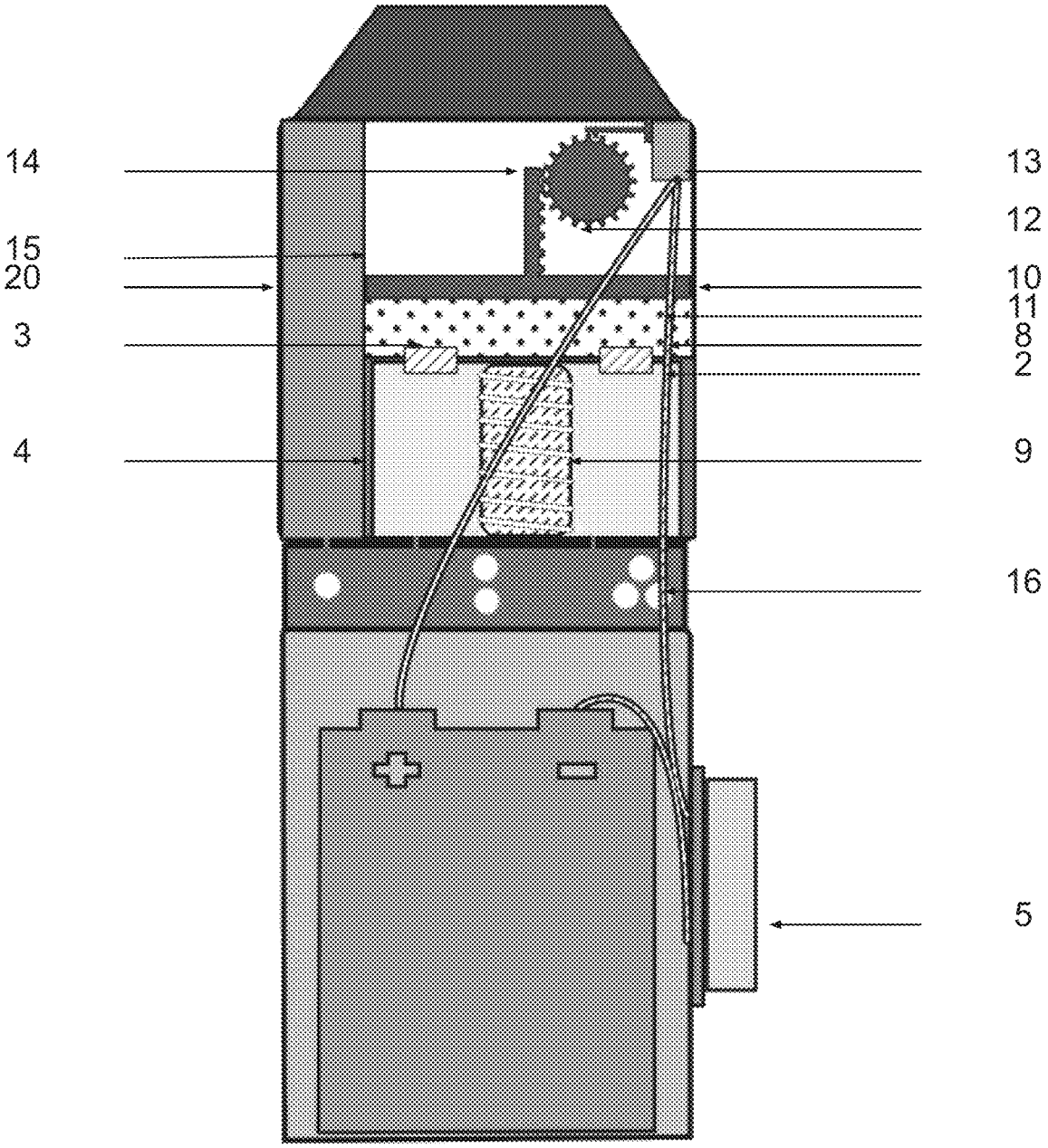
FIG. 9 is a cross-sectional view of an alternative embodiment of a vaporizing device.

FIG. 9 is a cross-sectional view of an alternative embodiment of a vaporizing device 900. Device 900 may offer enhanced control over the quantity of cannabis oil 11 which is dispensed to secondary chamber 4 and vaporized by coil 9. Device 900 may be particularly effective in precisely controlling the quantity of high viscosity cannabis oil 11 which is dispensed for vaporization. Similar to devices 700 and 800, primary reservoir 1 is embodied as a removable pod with a sealed port 2 which can be refilled and seated in one-way valve 3 to puncture sealed port 2 and initiate a fluid connection with secondary chamber 4.

In device 900, valve 3 can be a passive one-way valve, or an electro-mechanical valve. The dispensing mechanism 12 described in relation to device 900 may be configured to incrementally feed oil 11 from primary reservoir 1 to secondary chamber 4 rather than applying a more constant back pressure (as may be provided by, for example, spring 6).

As depicted in FIG. 9, primary reservoir 1 is fitted with a piston 10 which is held in place by tapered rim 15. Tapered rim 15 may hold piston 10 in place to ensure that piston 10 cannot fall from the top of primary reservoir 1 and cause oil 11 to spill. Dispensing mechanism 12 includes piston 10, ratcheting press arm 14, and electro-mechanical switch 13. Switch 13 may comprise a mechanical portion (e.g. a button which may be pressed by a user to actuate the switch and drive ratcheting press arm 14 down by an increment), and an electrical portion. The electrical portion may work in conjunction with the mechanical portion to activate coil 9 whenever the switch 7 is actuated.

When switch 7 is actuated, coil 9 will heat up while ratcheting press arm 14 pushes down on piston 10, which exerts a pressure or force on oil 11. The pressure exerted on oil 11 may be sufficient to overcome the cracking pressure of one-way valve 3, which will result in a specific volume of oil 11 being pushed into secondary chamber 4. Once the dispensed oil 11 enters secondary chamber 4 and comes into contact with heated coil 9, the oil 11 is heated to the temperature of vaporization. The user may then apply suction to vent 20, which is in fluid communication with air holes 16 and secondary chamber 4, thus allowing air drawn in through air holes 16 to mix with vapor from secondary chamber 4, thereby allowing the vapor to be inhaled.

Figure 5:
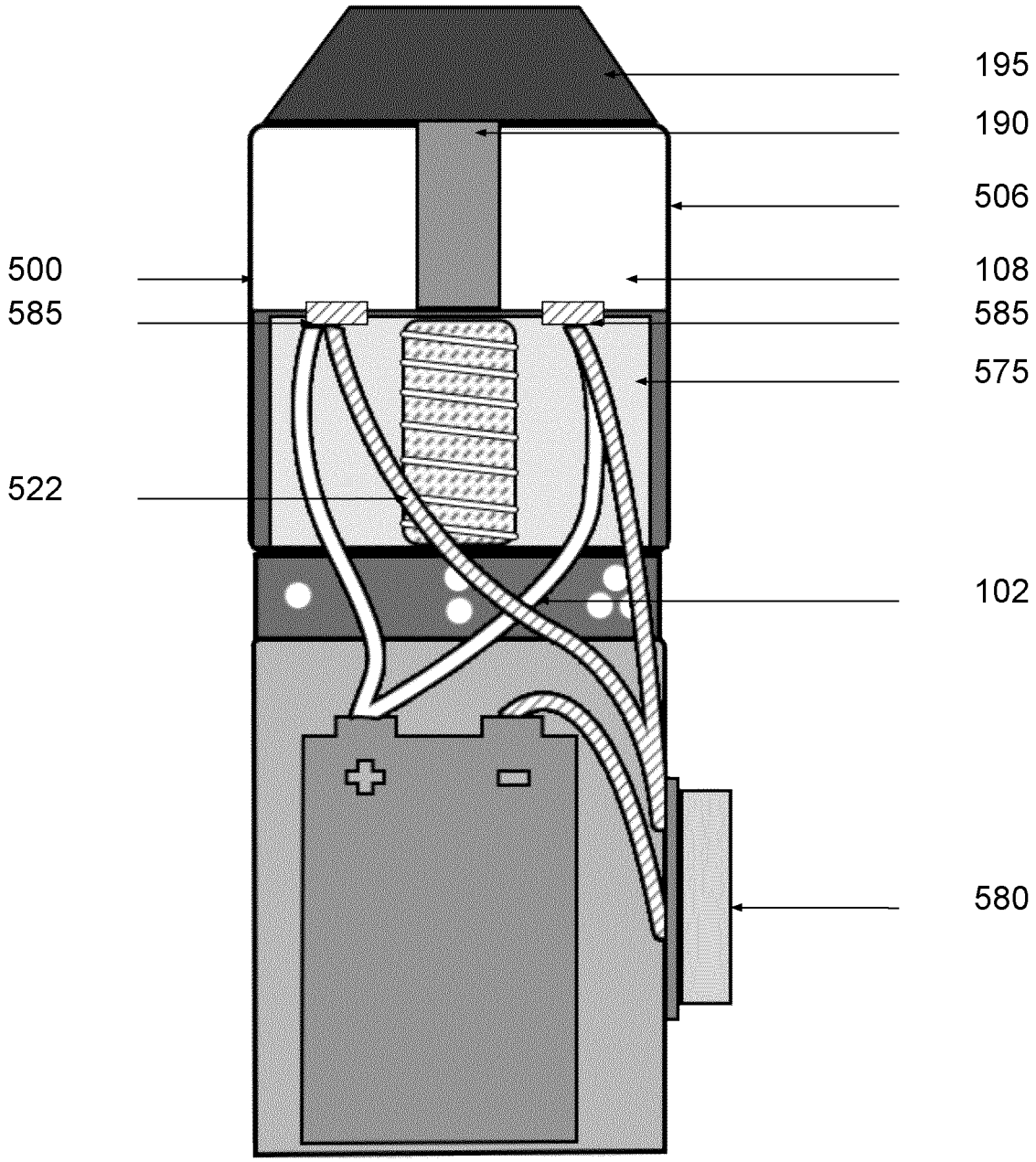
FIG. 5 is a cross-sectional view of an alternative embodiment of a vaporizing device.

FIG. 5 is a cross-sectional view of an alternative embodiment of a vaporizing device 500. As depicted, one or more electronic valves 585 between primary reservoir 506 and secondary chamber 575 may be triggered automatically or via a push button 580 rather than, for example, by a pressure sensor. In some embodiments, one or more signal wires 522 may be connected to a microcontroller for precise control of electronic valves 585 and other functionality such as the operation of a force/pressure sensitive resistor for monitoring the amount of oil in the secondary chamber. For example, once secondary chamber 575 is sensed to be low on oil, electronic valves 585 may be sent a signal to open and allow oil to flow from primary reservoir 506 and into secondary chamber 575 (for example, via the action of gravity).

Figure 6:
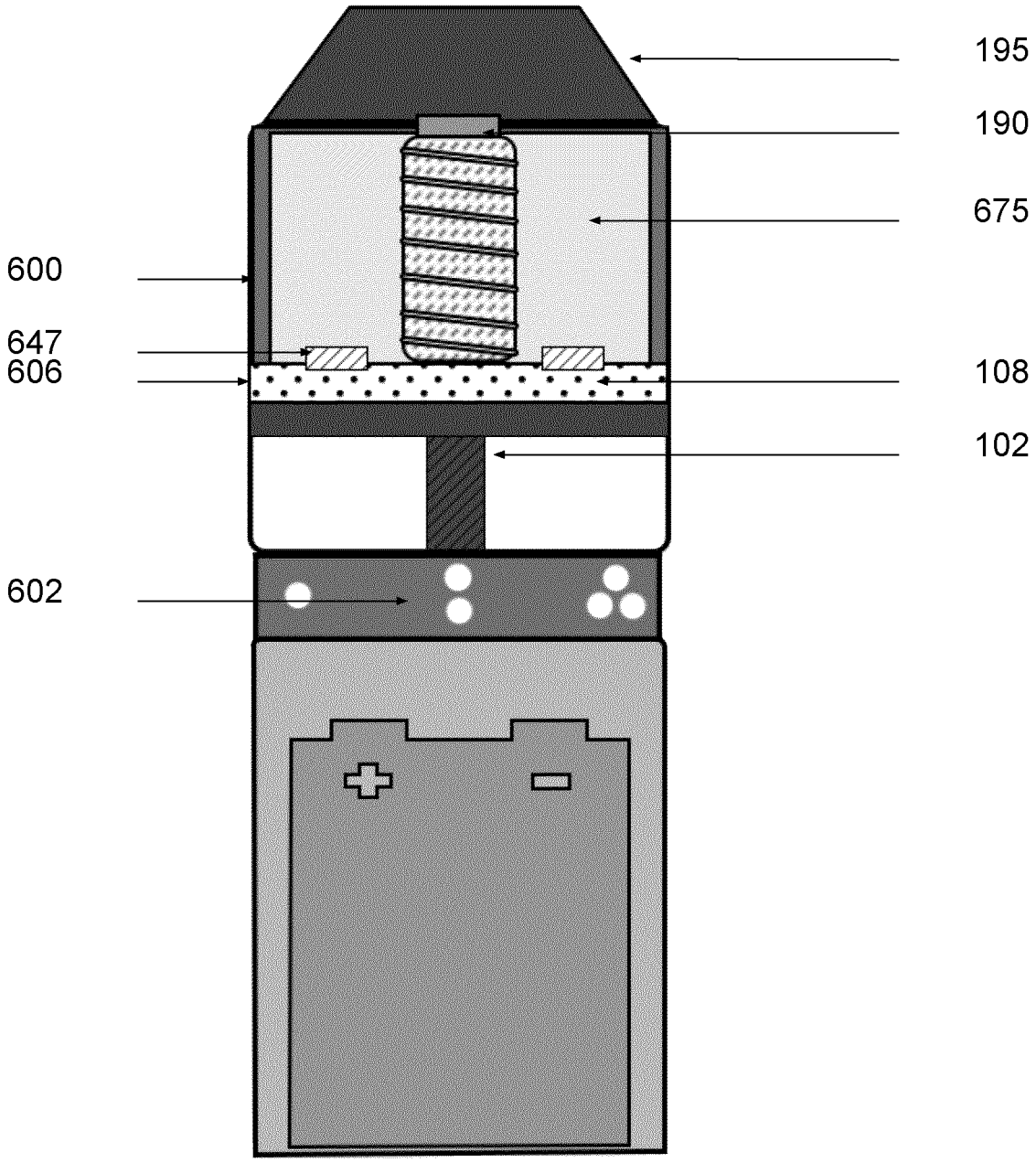
FIG. 6 is a cross-sectional view of an alternative embodiment of a vaporizing device.

FIG. 6 is a cross-sectional view of an alternative embodiment of a vaporizing device 600. Although secondary chamber 675 is depicted as being located vertically above primary reservoir 606, it is contemplated that in other embodiments, secondary chamber 675 may be located below primary reservoir 606. Device 600 includes a plunger 688 adjacent primary reservoir 606 which can be engaged in translational motion up and down the length of primary reservoir 606. When plunger 688 is pressed towards secondary chamber 675, oil 108 may be forced under pressure to travel from primary reservoir 606 to secondary chamber 675 via valves 647. As shown, air intake holes 602 may be located directly below secondary chamber 675 to ensure one continuous air channel to chimney 190.

Embodiments disclosed herein may be implemented using hardware, software or some combination thereof. Based on such understandings, the technical solution may be embodied in the form of a software product. The software product may be stored in a non-volatile or non-transitory storage medium, which can be, for example, a compact disk read-only memory (CD-ROM), USB flash disk, a removable hard disk, flash memory, hard drive, or the like. The software product includes a number of instructions that enable a computing device (computer, server, mainframe, or network device) to execute the methods provided herein.

Program code may be applied to input data to perform the functions described herein and to generate output information. The output information is applied to one or more output devices. In some embodiments, the communication interface may be a network communication interface. In embodiments in which elements are combined, the communication interface may be a software communication interface, such as those for inter-process communication. In still other embodiments, there may be a combination of communication interfaces implemented as hardware, software, and/or combination thereof.

Each computer program may be stored on a storage media or a device (e.g., ROM, magnetic disk, optical disc), readable by a general or special purpose programmable computer, for configuring and operating the computer when the storage media or device is read by the computer to perform the procedures described herein. Embodiments of the system may also be considered to be implemented as a non-transitory computer-readable storage medium, configured with a computer program, where the storage medium so configured causes a computer to operate in a specific and predefined manner to perform the functions described herein.

Furthermore, the systems and methods of the described embodiments are capable of being distributed in a computer program product including a physical, non-transitory computer readable medium that bears computer usable instructions for one or more processors. The medium may be provided in various forms, including one or more diskettes, compact disks, tapes, chips, magnetic and electronic storage media, volatile memory, non-volatile memory and the like. Non-transitory computer-readable media may include all computer-readable media, with the exception being a transitory, propagating signal. The term non-transitory is not intended to exclude computer readable media such as primary memory, volatile memory, RAM and so on, where the data stored thereon may only be temporarily stored. The computer useable instructions may also be in various forms, including compiled and non-compiled code.

The present disclosure may make numerous references to servers, services, interfaces, portals, platforms, or other systems formed from hardware devices. It should be appreciated that the use of such terms is deemed to represent one or more devices having at least one processor configured to execute software instructions stored on a computer readable tangible, non-transitory medium. One should further appreciate the disclosed computer-based algorithms, processes, methods, or other types of instruction sets can be embodied as a computer program product comprising a non-transitory, tangible computer readable media storing the instructions that cause a processor to execute the disclosed steps.

Various example embodiments are described herein. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

The embodiments described herein may be implemented by physical computer hardware embodiments. The embodiments described herein provide useful physical machines and particularly configured computer hardware arrangements of computing devices, servers, processors, memory, networks, for example. The embodiments described herein, for example, are directed to computer apparatuses, and methods implemented by computers through the processing and transformation of electronic data signals.

The embodiments described herein may involve computing devices, servers, receivers, transmitters, processors, memory(ies), displays, networks particularly configured to implement various acts. The embodiments described herein are directed to electronic machines adapted for processing and transforming electromagnetic signals which represent various types of information. The embodiments described herein pervasively and integrally relate to machines and their uses; the embodiments described herein have no meaning or practical applicability outside their use with computer hardware, machines, a various hardware components.

Substituting the computing devices, servers, receivers, transmitters, processors, memory, display, networks particularly configured to implement various acts for non-physical hardware, using mental steps for example, may substantially affect the way the embodiments work.

Such hardware limitations are clearly essential elements of the embodiments described herein, and they cannot be omitted or substituted for mental means without having a material effect on the operation and structure of the embodiments described herein. The hardware is essential to the embodiments described herein and is not merely used to perform steps expeditiously and in an efficient manner.

Although the present invention and its advantages have been described in detail, it should be understood that various changes, substitutions and alterations can be made herein without departing from the invention as defined by the appended claims. For example, although particular embodiments may be described with references to one-way valves, it will be understood that the use of other types of valves (e.g. ball valves) or other means for fluid communication (e.g. conduits) is contemplated.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

The invention claimed is:

1. An apparatus for vaporizing oil, the apparatus comprising:

a first chamber for storing oil to be vaporized;

a second chamber for vaporizing said oil, said second chamber being selectively fluidly coupled to said first chamber via a valve, and said second chamber being thermally insulated from said first chamber; and a chimney connecting said second chamber to an external vent.

2. The apparatus of claim 1, wherein the second chamber comprises a heating element for vaporizing said oil.

3. The apparatus of claim 1, wherein said oil is cannabis oil.

4. The apparatus of claim 1, wherein said valve is a one-way valve.

5. The apparatus of claim 1, wherein said valve is an electronic valve actuated by activating a trigger.

6. The apparatus of claim 1, wherein said second chamber is contained within said first chamber.

7. The apparatus of claim 1, wherein said first chamber is positioned vertically above said second chamber.

8. The apparatus of claim 1, wherein said valve is a vacuum-triggered valve connected to said chimney.

9. The apparatus of claim 1, wherein said second chamber is positioned vertically above said first chamber.

10. The apparatus of claim 9, further comprising a plunger for applying upward pressure to said oil in said first chamber.

11. The apparatus of claim 1, wherein said first chamber is configured to be compressed to supply additional oil to said second chamber.

12. A method of vaporizing oil, the method comprising:

Transporting said oil from a first chamber to a second chamber, said second chamber being thermally insulated from said first chamber, wherein said second chamber is selectively coupled to said first chamber via a valve;

vaporizing said oil via a heating element within said second chamber;

ventilating said vaporized oil from said second chamber to an external vent.

13. The method of claim 12, wherein said oil is cannabis oil.

14. The method of claim 12, wherein said valve is a one-way valve.

15. The method of claim 12, wherein said valve is an electronic valve actuated by activating a trigger.

16. The method of claim 12, wherein said second chamber is contained within said first chamber.

17. The method of claim 12, wherein said first chamber is positioned vertically above said second chamber.

18. The method of claim 12, wherein said value is a vacuum-triggered valve connected to said chimney.

19. The method of claim 12, wherein said second chamber is positioned vertically above said first chamber.

20. The method of claim 19, wherein transporting said oil comprises applying pressure to said oil via a plunger.

21. The method of claim 12, further comprising transporting additional oil to said second chamber by compressing said first chamber.

* * * * *